US005493885A

United States Patent [19]

Nomura et al.

[11] Patent Number: 5,493,885

[45] Date of Patent: Feb. 27, 1996

[54] METHOD AND APPARATUS FOR CONTROLLING ROLLING PROCESS IN HOT STRIP FINISH ROLLING MILL

[75] Inventors: Nobuaki Nomura; Hideyuki Nikaido; Yoshito Goto; Yoshiaki Kaneda; Hideyuki Yuzawa, all of Chiba, Japan

[73] Assignee: Kawasaki Steel Corporation, Hyogo, Japan

[21] Appl. No.: 208,478

[22] Filed: Mar. 10, 1994

[51] Int. Cl.[6] ..... B21B 37/00

[52] U.S. Cl. ..... 72/9.1; 72/234; 72/11.7

[58] Field of Search ..... 72/8–12, 17, 234, 72/240

[56] References Cited

U.S. PATENT DOCUMENTS

| | | | |
|---|---|---|---|
| 3,552,162 | 1/1971 | Gingher et al. | 72/8 |
| 3,592,031 | 7/1971 | Sutton et al. | 72/8 |
| 3,694,636 | 9/1972 | Smith, Jr. | 72/8 |
| 3,882,709 | 5/1975 | Kawamoto et al. | 72/234 |
| 4,711,109 | 12/1987 | Rohde et al. | 72/8 |

FOREIGN PATENT DOCUMENTS

| | | |
|---|---|---|
| 59-39410 | 3/1984 | Japan . |
| 60-127013 | 7/1985 | Japan . |
| 60-223605 | 11/1985 | Japan . |
| 62-168608 | 7/1987 | Japan . |
| 63-199009 | 8/1988 | Japan . |
| 1-266909 | 10/1989 | Japan . |
| 2-37908 | 2/1990 | Japan . |

*Primary Examiner*—Lowell A. Larson
*Assistant Examiner*—Thomas C. Schoeffler
*Attorney, Agent, or Firm*—Oliff & Berridge

[57] ABSTRACT

The sheet profile of a strip on the outlet side of a final stand coincides with a desired value without deforming the shape of the strip, by using a hot strip finish rolling mill having a number of rolling stands disposed sequentially. The rolling mill employs feedback control of upstream stands to reduce the error between a sheet profile measured by a sheet profile meter disposed at the outlet side of a selected stand and a desired sheet profile. The selected stand is the stand where the sheet thickness of the strip is at the percentage sheet crown critical sheet thickness. The sheet profile measured by the sheet profile meter is used to control the downstream stands using feed-forward control to make the sheet profile on the outlet side of the final stand coincide with the desired sheet profile.

11 Claims, 6 Drawing Sheets

METHOD AND APPARATUS FOR CONTROLLING ROLLING PROCESS IN HOT STRIP FINISH ROLLING MILL

BACKGROUND OF THE INVENTION

1. Field of the Invention

The present invention relates to a method for controlling a rolling process in a hot strip finish rolling mill. More particularly, this invention relates to a method and an apparatus for controlling a rolling process in a hot strip finish rolling mill to make the sheet profile of a strip at the outlet side of the final stand precisely coincide with a desired sheet profile.

2. Description the Related Art

In a hot strip finish rolling mill, the sheet thickness, the distribution of the sheet thickness (the sheet profile) across the width of the strip and the flatness and the like of the sheet are controlled. The sheet profile or the sheet crown is controlled by controlling crown control devices, disposed at each rolling stand forming the finish rolling mill. The crown control devices are controlled to make the sheet profile at the outlet side of the final rolling stand coincide with a desired sheet profile.

Therefore, in a conventional rolling mill, a sheet profile meter for measuring the sheet profile is disposed at the outlet side of the final rolling stand of the finish rolling mill. The results from the sheet profile meter are used to control the sheet profile of the product rolled by the final rolling stand. Further, a model for controlling the sheet profile is modified to minimize the control error for the next material to be rolled.

In this conventional sheet profile control system, a control model equation, shown in Equation (1), is used. In a tandem rolling mill having N stands, an equation corresponding to Equation (1) is used for each stand. This creates a system of N simultaneous equations. The desired sheet profile at the outlet side of the final rolling stand is obtained by solving for this system of equations. Equation (1) states:

$$Cr_i=\alpha_i \cdot Crm_i+\beta_i \cdot Cr_{i-1} \quad (1)$$

where $Cr_i$ is the sheet profile on the outlet side of the $i^{th}$ rolling stand, counted from the upstream to the downstream stand, $Crm_i$ is a so-called mechanical crown of the $i^{th}$ rolling stand, $Cr_{i-1}$ is the sheet profile of the outlet side of the $i-1^{th}$, or immediately upstream stand, $\alpha_i$ is the imprinting ratio of the mechanical crown of the $i^{th}$ rolling stand and $\beta_i$ is crown heredity coefficient of the sheet profile of the immediately upstream rolling stand. These factors will now be described.

The mechanical crown $Crm_i$ in Equation (1) is the amount of mechanical crown occurring due to deflection of the roll caused by the rolling load, by the thermal expansion of the roll or from the wear of the roll. Defining the crown occurring due to the deflection of the roll caused from the rolling load as $Cmp_i$, the crown occurring due to the thermal expansion of the roll as $CmRh_i$, and the crown occurring from the wear of the roll as $CmRw_i$, the foregoing mechanical crown $Crm_i$ is expressed by equation (2):

$$Crm_i=Cmp_i+CmRh_i+CmRw_i \quad (2)$$

The crown $Cmp_i$ in Equation (2), occurring due to the deflection of the roll is, in accordance with the widthwise directional load distribution, given from: 1) the deflection of the work roll and the backup roll (in addition, any change occurring due to the output from the crown control apparatus is included in the $Cmp_i$ factor); and 2) the function $f_1$ expressed in Equation (3). Equation (3) is formulated by considering the initial crown of the roll. In the following equation, P is the rolling load, b is the width of the material and x is the output from the crown control apparatus.

$$Cmp_i=f_1(P, b, x) \quad (3)$$

The heat crown $CmRh_i$ occurring due to the thermal expansion of the roll is determined from the change in the roll crown as the sheet is rolled and cooled after rolling. Specifically, the heat crown is determined by, for example, first-order response lag approximation and by obtaining each time constant and proportional constant and the like from experimental data by means of regression.

If the surface condition of the roll changes when the heat crown is determined, such that a black skin forms or separation takes place as the sheet is rolled in the hot strip finish rolling mill and such that the resulting change in the frictional coefficient or the heat transference coefficient changes the amount of heat flowing from the strip to the roll, an estimation error in the heat crown occurs. However, such a change in the heat flow cannot be measured. Thus, the error in the estimated heat crown cannot be precisely determined.

The wear crown $CmRw_i$ occurring due to the wear of the roll is expressed by Equation (4), defining the function $f_2$, where $C_f$ is a friction coefficient, L is length of rolling and D is the diameter of the roll.

$$CmRw_i=C_f f_2(P, L, b, D) \quad (4)$$

In Equation (4), $C_f$ is determined from regression of the result of rolling the sheet. However, the degree of the wear of the roll changes due to the characteristics of the sheet's material and the surface condition of the sheet. Therefore, errors occur when estimating the wear crown $CmRw_i$ due to the wear of the roll.

The imprinting ratio $\alpha_i$ in Equation (1) is given by function $f_3$ expressed by Equation (5):

$$\alpha_i=f_3(h, L_d, K_{ch}, \xi) \quad (5)$$

where h is the sheet thickness on the outlet side of the $i^{th}$ rolling stand), $L_d$ is the length of the contact arc, $K_{ch}$ is the regression coefficient, which changes with the sheet width, the length of the contact arc and the deformation resistance and the like, and $\xi$ is a shape factor given by function $f_4$ expressed by Equation (6):

$$\xi=f_4(D, h, b) \quad (6)$$

The crown heredity coefficient $\beta_i$ is given by function $f_5$ expressed by Equation (7), where H is the sheet thickness on the inlet side (of the $i^{th}$ rolling stand):

$$\beta_i=f_5(K_{ch}, L_d, \xi, h, H) \quad (7)$$

The imprinting ratio $\alpha_i$ in Equation (5) and the crown heredity coefficient $\beta_i$ in Equation (7) have, as variables, the regression factor $K_{ch}$ and the shape factor $\xi$ which can be obtained from regression. However, the variables $\alpha_i$ and $\beta_i$ are determined experimentally.

A conventional and usual sheet profile control method using Equation (1) will now be described, relating to a hot strip finish rolling mill having seven stands (first to seventh stands F1 to F7).

First, the strip pass schedule for the finish rolling is estimated. The rolling load to be applied at each stand is calculated to obtain the desired final percentage sheet crown $Rc_7^{Des}$ ($=Cr_7^{Des}/h_7$) from the sheet thickness on the outlet side of the finish rolling mill. The percentage sheet crown $Rc_7^{Des}$ is the ratio of the sheet thickness $h_7$ on the outlet side of the seventh stand F7 and the desired sheet crown $Cr_7^{Des}$ of the seventh stand F7. Further, the percentage sheet crown is used to determine the desired crown $Cr_i^{Des}=Rc_7^{Des}\cdot h_i$ on the outlet side of each stand F1–F7 in accordance with the pass schedule.

Then, the desired mechanical crown $Crm_1^{Des}$ for achieving the desired sheet crown $Cr_i^{Des}$ for each stand is determined from Equation (1). Further, the output from the crown control apparatus necessary to achieve the desired mechanical crown is determined.

Then, the strip is actually rolled. The sheet crown $Cr_7$ at the final stand F7 is measured by the sheet profile meter disposed at the outlet side of the final stand F7. The measured crown $Cr_7$ at the outlet side is used to obtain the actual percentage sheet crown $Rc_7$ ($=Cr_7/h_7$).

Then, the percentage sheet crown at the outlet side of each stand is assumed to be the same as the actual percentage sheet crown $Rc_7$ at the outlet side of the seventh stand F7. The actual rolling load at each stand and the actual percentage sheet crown $Rc_7$ are used to obtain the error $S_i$ at each stand from Equation (1). That is, the sheet crown $Cr_i$ on the outlet side of the $i^{th}$ stand is obtained from $Rc_7\times h_i$, and the error $S_i$ that makes Equation (8) true is obtained. It should be noted that the mechanical crown $Crm_i$ is calculated by using the actual rolling load. Equation (8) states:

$$Cr_i=\alpha_i\cdot Crm_i+\beta_i\cdot Cr_{i-1}+S_i \quad (8)$$

After the sheet crown $Cr_i$ for each stand has been calculated from Equation (8), the control model is modified using Equation (8) to set the crown for the next material to be rolled. In addition, the error $S_i$ is used to obtain an adequate value for the mechanical crown $Crm_i$ so that the sheet crown at the outlet side of each stand will coincide with the desired sheet crown. Feedback control is also used so that the output from the crown control apparatus of each stand is changed to coincide with the obtained mechanical crown $Crm_i$.

As specifically described above, the conventional hot strip finish rolling mill employs a method for controlling the sheet profile control apparatus for each stand based on the results of the measurement performed by the sheet profile meter disposed at the outlet side of the final stand.

The substantially same conventional rolling mill is disclosed in, for example, Japanese Patent Laid-Open No. 60-223605, which discloses using one sheet profile control apparatus for the final stand of the finishing mill, and one sheet profile control apparatus for a stand disposed upstream one stand from the final stand, to control the sheet profile and the sheet shape. Thus, the sheet crown and the sheet shape are controlled to desired values so that both the desired sheet crown and the desired sheet shape are obtained in the milling process. However, this method risks that the shape will be distorted between the final stand and the stand upstream one stand from the final stand, which causes the rolling operation to encounter a problem.

In order to prevent distortion of the sheet at the intermediate stand, methods for controlling through the upstream stand are disclosed in Japanese Patent Laid-Open No. 60-127013, Japanese Patent Laid-Open No. 63-199009 and Japanese Patent Laid-Open No. 1-266909. Generally, control performed prior to the intermediate stage of the finishing mill is effective for the hot rolling operation because the strip is thin and the crown control ability is unsatisfactory at the last stands. Therefore, the methods disclosed in these references are effective control methods because the control is performed prior to the last stand(s)..

Further, Japanese Patent Laid-Open No. 62-168608 and Japanese Patent. Laid-Open No. 2-37908 each discloses a control method in which a sheet profile meter is disposed on the inlet side of a tandem rolling mill.

Japanese Patent Laid-Open No. 59-39410 discloses measuring the sheet profile at the forward stand to control the sheet profile at the forward stand based on the measurement, coarsely controlling the shape at the rear stand, measuring the flatness on the outlet side of the final stand, and precisely controlling the flatness at the rear stand based on the measurement.

However, the methods disclosed in Japanese Patent Laid-Open No. 60-127013 and the like require a too long conveyance time between adjacent stands. Therefore, the control system wastes time. As a result, unsatisfactory control response occurs in these systems.

The method disclosed in Japanese Patent Laid-Open No. 62-168608 encounters a problem in that no significant effect on the sheet profile can be obtained in the hot rolling process because the metal flow is too large in the widthwise direction of the strip. Therefore, the influence on the change in the sheet profile on the inlet side of the tandem rolling mill is limited.

The method disclosed in Japanese Patent Laid-Open No. 59-39410 performs feedback control using the sheet profile measured at the forward stand. However, the percentage sheet crown can change without any distortion in the shape in the rear of the intermediate stand, because the strip is thick in the hot rolling process. As a result, an excessive error occurs in the intermediate stand even if feedback control is performed. Accordingly, control of the sheet profile on the outlet side of the final stand is unsatisfactory. Moreover, the obtainable effect is unsatisfactory in a case where the shape is feed-forward-controlled.

SUMMARY OF THE INVENTION

The present invention overcomes the problems experienced with the conventional rolling mills. Therefore, this invention provides a method for controlling a rolling process of a hot strip finish rolling mill that exhibits excellent response and enables a sheet profile of a strip, including the leading portion on the outlet side of a final stand, to precisely coincide with a desired sheet profile. This invention also provides an apparatus operating according to this method.

According to a first preferred embodiment of the invention, a method for controlling a rolling process is adapted to a hot strip finish rolling mill having a plurality of sequentially disposed rolling stands. The method for controlling the rolling process comprises the step of measuring a sheet profile of a strip with a sheet profile meter. The profile meter is disposed on the outlet side of a selected stand. The selected stand is the stand which causes the sheet thickness of the strip to reach a percentage sheet crown critical sheet thickness. The method also comprises the steps of obtaining an error measurement between the measured sheet profile and a desired profile at the critical sheet thickness, and controlling the upstream rolling stands to reduce the error.

Other and further objects, features and advantages of the invention will be appear more fully from the following description.

BRIEF DESCRIPTION OF THE DRAWINGS

The preferred embodiments will be described in reference to the following drawings, in which.

PREFERRED EMBODIMENTS OF THE PRESENT INVENTION

Since the widthwise directional change in the thickness of the strip causes difference in the elongation of the strip to take place if the sheet profile is changed considerably in rear stages of a hot strip finishing mill in which the sheet thickness is thin, the strip finally buckles, resulting in a defective shape, such as center buckles or wavy edges,to occur. Since the foregoing defective shape excessively deteriorates the rolling characteristics, it is actually extremely difficult to considerably change the sheet profile in the rear stages of the hot strip finishing mill Therefore, the sheet thickness must be, without the change of the sheet profile, reduced at stands, at which the sheet thickness is thinner than a predetermined limit, in order to prevent to defective shape, such as the center buckles or wavy edges. That is, rolling must be performed in those rolling stands such that the percentage sheet crown of the strip is kept constant. Therefore, the percentage sheet crown of the final product must be obtained before the strip has been thinned to or below the predetermined thickness.

The percentage sheet crown is expressed by $$RC_i = \frac{h_c - h_e}{h_c} = 1 - \frac{h_e}{h_c} \tag{9}$$

where $h_c$ is the sheet thickness at the central portion of the sheet and $h_e$ is the sheet thickness at the widthwise end(s) of the sheet.

Figure 1:
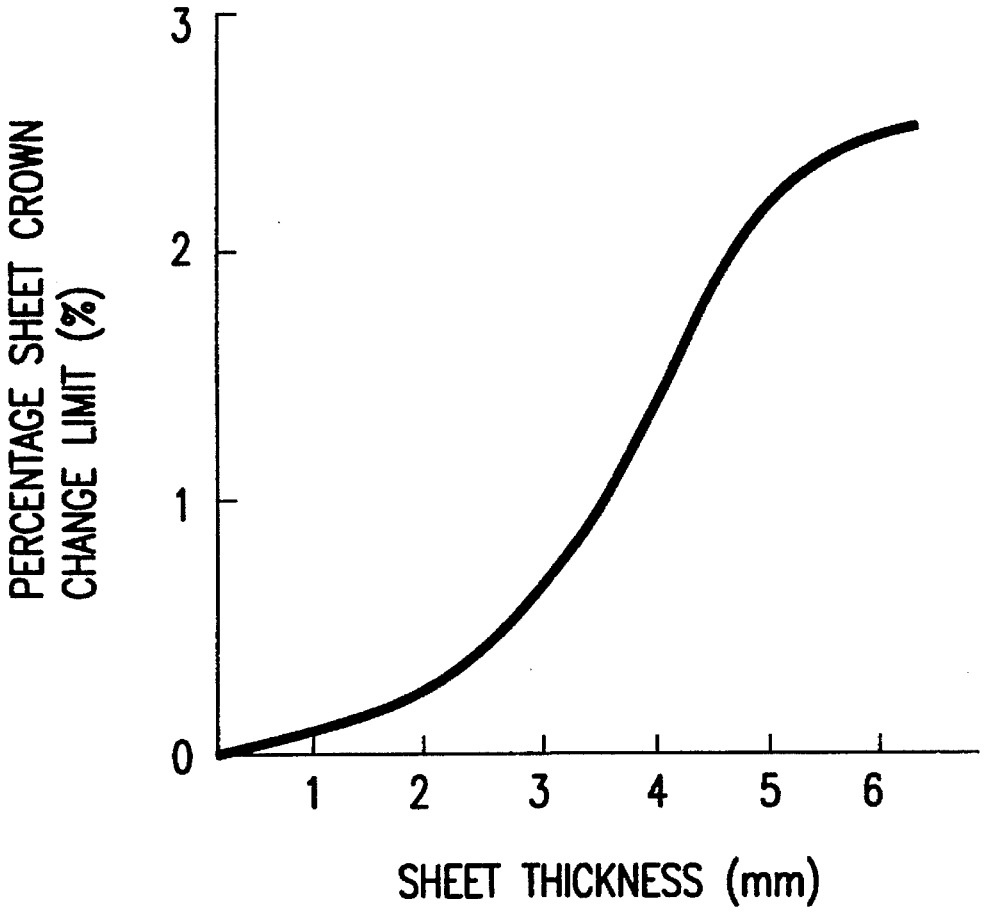
FIG. 1 is a graph which illustrates the relation between the sheet thickness of a strip and a percentage sheet crown change limit.

As apparent from the above description, the percentage sheet crown, which can be controlled, has a limit depending upon the thickness. The limit value is defined as the percentage sheet crown change limit. The amount of change in the percentage sheet crown change limit relative to the sheet thickness is shown in FIG. 1. That is, the percentage sheet crown change limit changes rapidly in a region in which the sheet thickness is small, while the percentage sheet crown change limit is saturated and becomes fixed if the sheet thickness exceeds a first predetermined value or falls below a second predetermined value. This is shown in FIG. 1.

In hot-strip-rolling common steel, the percentage sheet crown change limit begins increasing once the sheet thickness exceeds 2 mm or more. If the sheet thickness exceeds 4 mm, the percentage sheet crown change limit levels off and becomes saturated. Likewise, if the sheet thickness is below 2 mm, the percentage sheet crown change limit becomes saturated at a low value. The percentage sheet crown change limit is determined by the sheet width, sheet thickness, resistance for deformation and the Young's modulus of the material to be rolled.

The rolling process for the upstream side, relative to the position for measuring the sheet profile, is controlled so that the percentage sheet crown is determined during a period when the percentage sheet crown change limit is sufficiently large. In the downstream side, the sheet is rolled with the percentage sheet crown kept constant. As a result, a hot rolled product, having a desired percentage sheet crown and no defective shape, can be manufactured.

Although the percentage sheet crown can be changed in an upstream region where the strip is thick, determination of the percentage sheet crown when the strip is thick is meaningless, because the percentage sheet crown is easily changed at the stands downstream from that upstream region.

Figure 2:
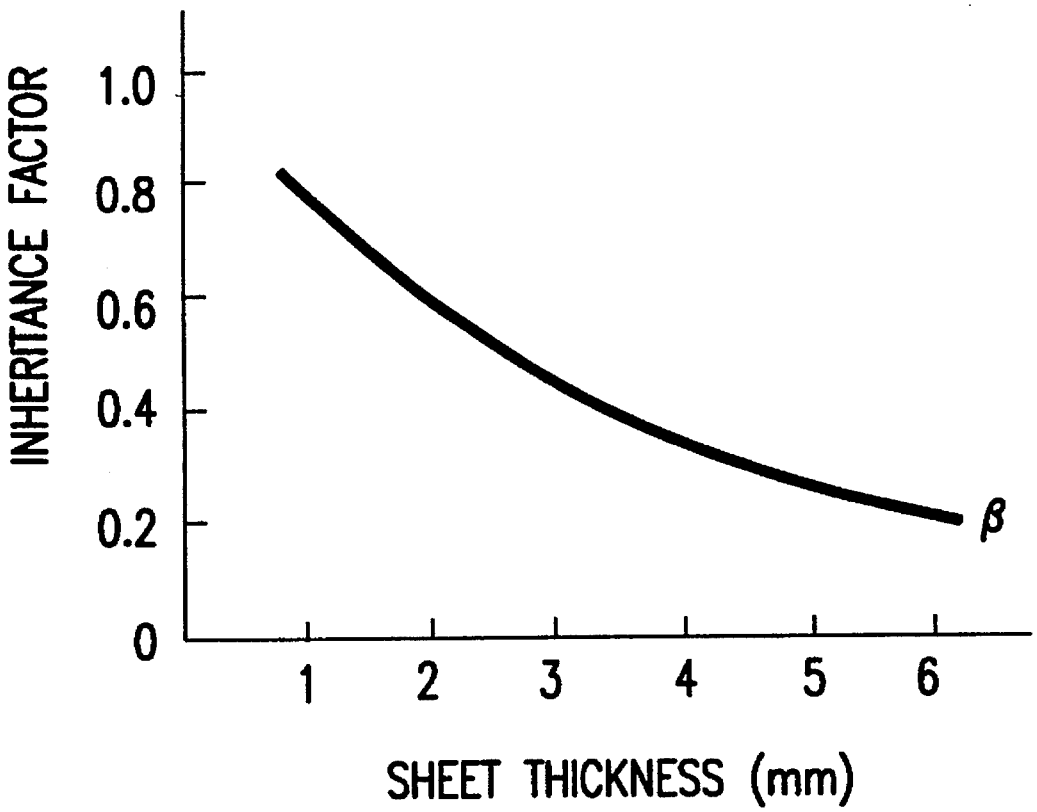
FIG. 2 is a graph which illustrates the relation between an crown heredity coefficient and the sheet thickness.

As apparent from the relationship between the crown heredity coefficient $\beta_i$ and the sheet thickness expressed in Equation (1), a distortion is enlarged in the downstream stands, although $\beta_i$ is small when the strip is thick. That is, as shown in FIG. 2, the crown heredity coefficient $\beta_i$ of each stand i decreases as the stand number i increases and the thickness of the sheet decreases. Therefore, the sheet profile is desirably maintained during the rolling process performed before the strip reaches the outlet side of the final stand. As a result, control of the sheet profile of the final product deteriorates undesirably. Consequently, measuring the sheet profile while the strip is still considerably thick means the measurement cannot be used effectively to control the crown profile.

Figure 3A:
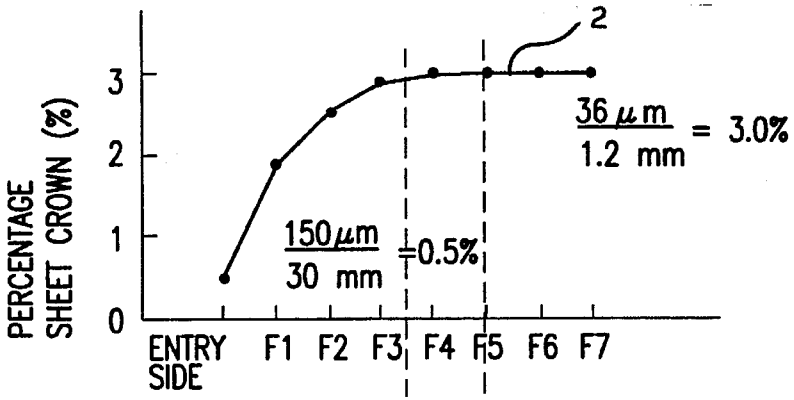
FIGS. 3A–3C show a schematic view which illustrates the relation between the percentage sheet crown, the sheet thickness and the percentage sheet crown limit in a hot strip finish rolling mill.
Figure 3B:
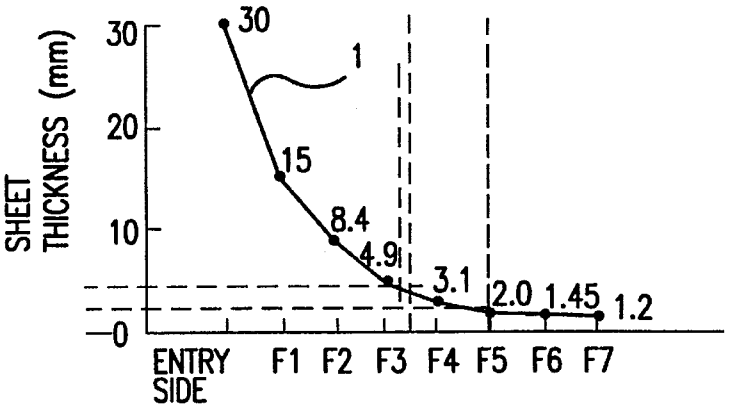
Figure 3C:
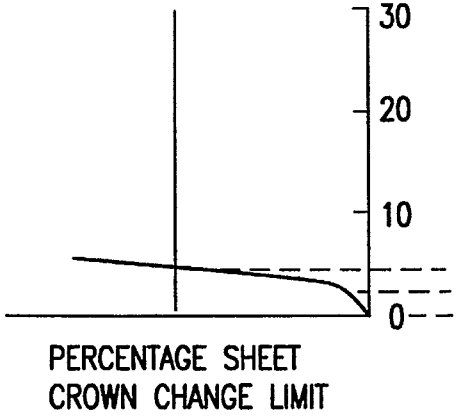

FIGS. 3A–3C show a group of graphs which illustrate the relationships between the percentage sheet crown, the sheet thickness and the percentage sheet crown change limit in a hot strip mill. That is, as shown in FIG. 3B, the sheet thickness decreases from 30 mm to 1.2 mm while the strip passes through stands F1 to F7. The percentage sheet crown changes from 0.5%, the value of the roughly rolled material input to the first stand F1, to 3%, the desired percentage sheet crown of the final product as output from the last stand F7. However, the percentage sheet crown should not change in those regions where the strip is thin but the percentage sheet crown change limit is not saturated. Those regions extend from a region from stand F5 to stand F6, as shown by aligning FIG. 3C with FIG. 3B.

FIG. 3C shows the percentage sheet crown change limit plotted against the sheet thickness for the 30 mm range of a sheet as it is rolled. Therefore, the percentage sheet crown is altered during the rolling process through stands F1–F4, but is generally maintained thereafter, as shown in FIG. 3A. That is, in the present invention, the percentage sheet crown is determined at a moment before the strip is introduced into the fifth stand F5 and the percentage sheet crown is not basically changed during the rolling on stands F5, F6 and F7. The sheet thickness when the percentage sheet crown is determined is important and is defined as the percentage sheet crown critical sheet thickness. The percentage sheet crown critical sheet thickness is defined as the thickness where: 1) no shape defect takes place even when the percentage sheet crown is substantially changed and the sheet is thicker than the critical thickness; and 2) shape defect takes place when the percentage sheet crown is substantially changed and the sheet is thinner than the critical thickness.

Therefore, in this invention, the percentage sheet crown is measured when the sheet thickness is at the percentage sheet crown critical sheet thickness. This measured percentage sheet crown is used to control the upstream stands so that a desired percentage sheet crown is obtained before imputing the sheet to the downstream stands. Thus, the percentage sheet crown is not considerably changed in the downstream stands and center buckle and the like is avoided.

In this invention, a sheet profile meter is disposed between a first stand and a second stand in which the strip is already thinner than the percentage sheet crown critical sheet thickness. The error value is obtained between the measured sheet profile obtained between the first and second stands and a desired sheet profile previously determined for the region between the first and second stands. Feedback control of rolling stands located upstream from the second stand is used to reduce the error.

The feedback control is performed by measuring, using the sheet profile meter, the sheet profile of a strip which is allowed to pass between the first and second stands. Then, the desired percentage sheet crown is determined from the desired sheet profile of the product. Next, a profile control apparatus, such as a roll bender or a roll intersection angle adjustment apparatus, is operated so that the actual percentage sheet crown obtained from the profile meter coincides with the desired percentage sheet crown. The controlled roll bender or the like is disposed at a rolling stand located upstream from the sheet profile meter.

By using feedback control, even if errors occur between the measured sheet profile and the desired sheet profile at the profile meter position, the sheet is driven to the desired sheet profile between the stands at the sheet profile measuring positions thereafter. Therefore, by controlling the strip such that the percentage sheet crown is constant, the sheet profile of the product on the outlet side of the finish rolling mill will precisely coincide with the desired value. By employing the method of this invention, comprising measuring the sheet profile of a strip with a sheet profile meter and providing feed-forward control to the rolling stands located downstream of the sheet profile meter, the sheet profile on the outlet side of the final stand will precisely coincide with a desired value without damaging the sheet shape.

Specifically, the downstream rolling stands are controlled based on the measured error between the actual sheet profile and the desired sheet profile determined at the sheet profile meter position. In this case, the actual percentage sheet crown is obtained from the measured results and the percentage sheet crown can be changed within, for example, the allowable range shown in FIG. 1 based on the error between the actual percentage sheet crown and the desired percentage crown. Therefore, changing the percentage sheet crown of the rolling stands located downstream from the sheet profile meter within the foregoing allowable range enables the sheet profile at the outlet side of the final stand to coincide with the desired value without damaging the sheet shape. The quantity of the change of the sheet crown from the downstream stands is obtained as follows.

For example, the sheet crown at the outlet side of the fourth stand F4 is measured. The determined error quantity, $\Delta Cr_4$, between the measured sheet crown $Cr_4$ and desired sheet crown $Cr_4^{Des}$ at the outlet side of the fourth stand F4 is corrected at the fifth stand F5. In this case, the error quantity $\Delta Cr_5$ for the change in the sheet crown at the outlet side of the fifth stand F5 can be obtained from Equations (9):

$$\Delta Cr_5=\beta_5\Delta Cr_4 \tag{9}$$

where $$\Delta Cr_4=Cr_4-Cr_4^{Des}$$

If the shape is damaged when the sheet crown is changed at only the fifth stand F5, as described above, the amount of the change in the sheet crown can be distributed between the fifth stand F5 and the sixth stand F6 or between a plurality of the fifth, sixth and seventh stands F5–F7. As an alternative, the sheet crown may be changed at only the sixth stand F6 or at only the seventh stand F7.

The sheet profile at the outlet side of the final stand is predicted based on the actual sheet profile obtained by the sheet profile meter. Thus, the rolling stands disposed downstream from the sheet profile meter are controlled such that the error between the predicted sheet profile and the desired sheet profile at the outlet side of the final stand is minimized. Also in this case, the sheet profile at the outlet side of the final stand can be made to coincide exactly with the desired sheet profile. In order to obtain the predicted sheet profile at the outlet side of the final stand from the measured sheet profile, Equations (1) to (7) are used.

The amount of the change in the percentage sheet crown input to the downstream rolling stands for reducing the error between the predicted sheet profile and the desired sheet profile is obtained as follows.

Take, for example, the sheet crown at the outlet side of the fourth stand F4. In order to predict the sheet crown at the outlet side of the seventh stand F7 from the measured sheet crown $Cr_4$ at the outlet side of the fourth stand F4, Equations (1) to (7) are used. In order to make the sheet crown $Cr_7$ at the outlet side of the seventh stand F7 equal to the desired sheet crown $Cr_7^{Des}$ at the outlet side of the seventh stand F7, the sheet crown at the outlet side of, for example, the fifth stand F5 is changed by a change quantity $\Delta Cr_5$ obtained from Equations (10):

$$\Delta Cr_5=(1/(\beta_6\cdot\beta_7)\Delta Cr_7 \tag{10}$$

where $$\Delta Cr_7=Cr_7-Cr_7^{Des}$$

If the shape is distorted when the sheet profile is changed only the fifth stand F5 as described above, control may be performed by distributing the correction amount to a plurality of stands, similarly to the case described above where the error between the measured sheet crown at the fourth stand F4 and the desired sheet crown is used to change the downstream stands.

The method based on Equations (9) eliminates the error occurring in the passage through the fifth stand F5 due to the error, $\Delta Cr_4$, detected at the outlet side of the fourth stand F4. This method is used when the sheet profile of the leading portion of the strip is controlled because no actual data from the fifth stand F5 is present and therefore prediction of the sheet crown at the seventh stand F7 does not have any significant meaning.

On the other hand, the method based on Equations (10) predict the sheet crown $Cr_7$ at the outlet side of the seventh stand F7 based on the measured sheet crown $Cr_4$ at the outlet side of the fourth stand F4. In this method, the actual value realized during the rolling process is used to predict the crown value $Cr_7$ in a manner different from the prediction made at the time of performing setting by calculations. In contrast with the method based on Equations (9), which eliminates the error generated up to and including the fourth stand F4, the method based on Equations (10) eliminates the error generated from the fifth stand F5 by using the results of the rolling process to predict $Cr_7$.

The present invention enables the foregoing problems to be solved satisfactorily with a rolling control method adapted to a hot strip finish rolling mill having a plurality of rolling stands disposed in tandem. The method comprises obtaining an error occurring between the measured sheet profile, obtained by a sheet profile meter, and a predicted sheet profile for the sheet profile meter position, obtained from a sheet profile control model equation, and updating a correction term in the sheet profile control model equation to minimize the error.

In this embodiment, the sheet profile of a strip is measured by the sheet profile meter disposed between the stands rather than at the outlet side of the final stand. The error between the measured sheet profile and the predicted sheet profile is minimized by updating the correction term included in the model equation. Therefore, placing a sheet profile meter in at least one region between stands enables the rolling stands to be divided into a plurality of sections and the model to be updated using the actual value obtainable at the division point. Thus, the error experienced with the conventional technology can be precisely distributed to respective stands. In particular, when the sheet profile meters are disposed at every region between two adjacent stands, model updating at each stand can be performed. Thus, having to distribute the error between various stands is eliminated. As a result, the model can be updated with significant precision.

Updating the model using Equation (1), which is the control model equation, will now be described. First, a sheet profile meter is placed at the outlet side of the $i^{th}$ stand to measure the sheet profile $Cr_i$. Then, the error between the measured sheet profile $Cr_i$ and a predicted sheet profile is obtained. The predicted sheet profile is previously obtained based on Equations (1) and (2). Then, the correction term included in the control model equation is updated to reduce the error $S_i$, in Equation (8).

The correction term will now be described. First, Equation (1) is deformed to obtain Equation (12):

$$Cr_i=\alpha_i(1+C_0)\cdot(Crm_i+C)+\beta_i(1-C_1)\cdot Cr_i-1 \quad (12)$$

where $C_0$ is the correction term for the imprinting ratio $\alpha_i$, $C_1$ is the correction term for the crown heredity coefficient $\beta_i$, and C is the correction term for the mechanical crown $Crm_i$.

The error of the sheet profile can be decomposed into two factors, each of which can be estimated. That is, one error, which gradually changes with time, occurs due to the heat expansion and wear of the roll. If this kind of error takes place, the correction term C is modified. If the characteristics of the sheet material to be rolled are different, the degree of the error altered accordingly. This occurs due to the characteristics of the material. Therefore the correction terms $C_0$ and $C_1$ are corrected when this type of error occurs.

The imprinting ratio $\alpha_i$ and the crown heredity coefficient $\beta_i$ are related by Equation (1). Therefore, this relation enables Equations (13) and (14) to be obtained:

$$\alpha_i=(h_{1-1}/h_i)\cdot\beta_i=1 \quad (13)$$

$$\alpha_i(1+C_0)+(h_{i-1}/h_i)\cdot\beta i(1-C_1)=1 \quad (14)$$

Since the relation between correction terms $C_0$ and $C_1$ can be deduced from Equation (13) and (14), $C_0$ and $C_1$ can be treated as substantially a single correction term.

Since this model updating method suffers from unsatisfactory precision when decomposing the error into two components, it is sometimes preferable, for simplicity, to employ a method in which all of the errors are included in the single correction term C.

This model updating method based on Equation (12) is provided as an example, and therefore another method may, of course, be employed.

When updating the correction term, the conventional method, in which the sheet profile is measured at the outlet side of the final stand, is used assuming that the percentage sheet crown $Rc_1$ is the same at each stand. In contrast, this invention enables the percentage sheet crown to be directly obtained from the measured sheet profile.

Therefore, the model can be precisely updated. Accordingly, the error $S_i$ in Equation (8) can be assuredly minimized. As a result, setting the initial conditions of the rolling mill for the next rolling operation can be accurately performed. Thus, the sheet profile can be made to precisely coincide with a desired sheet profile from the leading edge of the strip.

When a measured roll profile of a work roll at the $i^{th}$ stand and measured by a roll profile meter is used together when updating the model, the error from the predicted error of the roll profile and the error from the various specifications of the material to be rolled can be separated quantitatively. For example, when updating the model based on Equation (12), the correction term C can precisely be obtained. As a result, the correction terms $C_0$ and $C_1$ can also precisely be obtained. Thus, the precision in updating the model can be improved.

When a roll profile meter is not disposed, the factor of the error $S_i$ in Equation (8) cannot be specified. When the roll profile meter is disposed at the rolling stand, as in this invention, the error in the crown, $CmRh_i$, due to the thermal expansion of the foregoing rolling stand and the error in the crown, $CmRw_i$, due to the wear of the roll, can directly be detected in the form of a total amount. Therefore, the residual factors of the error arise from the imprinting ratio $\alpha_i$ of the mechanical crown, the crown heredity coefficient $\beta_i$ and the sheet crown $Cr_{i-1}$ at the outlet side of the previous stand.

At rolling stands where the strip is thick, the value of the crown heredity coefficient $\beta_i$ is small, as shown in FIG. 2. Therefore, placing the roll profile meter at an appropriate rolling stand results in the influence of the error in the sheet crown $Cr_{i-1}$ at the outlet side of the previous stand being reduced. As a result, updating the imprinting ratio $\alpha_1$ to be used to set the rolling conditions for the next material to be rolled enables the control precision to be significantly improved.

The sheet profiles on the inlet side and the outlet side of the $i^{th}$ rolling stand are respectively measured by separate sheet profile meters. The mechanical crown of the $i^{th}$ rolling stand is obtained by measuring the rolling load detected when rolling a sheet. These measures are used to update the imprinting ratio of the mechanical crown and the crown heredity coefficient of the sheet profile at the inlet side. These factors are included in the model equation for controlling the $i^{th}$ sheet profile. In this case, the measured sheet profiles $Cr_{1-1}$ and $Cr_i$, respectively, are directly measured at the inlet side and the outlet side of the $i^{th}$ rolling stand. The mechanical crown $Crm_i$ of the rolling stand is obtained from the load detection or the like measured when performing the rolling process. These measurements are applied to Equation (8). Then, regression analysis is performed, in an on-line manner or the like, to minimize the error $S_i$. The imprinting ratio $\alpha_i$ of the mechanical crown and the crown heredity coefficient $\beta_i$ of the sheet profile at the inlet side in Equation (1) are modified so that the precision in predicting the sheet profile when performing the next rolling operation can be improved.

The roll profile of a rolling stand is measured by a roll profile meter disposed at the rolling stand. when the roll profile is used to update the model, all of the sheet profiles $Cr_i$ and $Cr_{i-1}$ at the outlet side and the inlet side, respectively, of the $i^{th}$ rolling stand required to calculate the sheet profile based on Equation (1) can be used. Likewise, the sum ($CmRh_i$+$Cmrw_i$) of the crown, based on the heat expansion of the roll at the stand and the wear of the roll and the like, can be used since they are measured values. As a result, the residual error factors include only imprinting ratio $\alpha_i$ and the crown heredity coefficient $\beta_i$. Therefore, the imprinting ratio $\alpha_i$ and the crown heredity coefficient $\beta_i$ can easily be optimized by, for example, regression. As a result, the model equation update precision can be improved. Accordingly, the precision when initially setting the rolling conditions for the next material to be rolled can be improved.

When updating the model using the sheet profile measured between the stands and by obtaining the error between the sheet thickness, the error is measured by, for example, a sheet profile meter and the predicted sheet thickness. The error is calculated based on the sheet thickness control model equation and used to update the correction terms included in the sheet thickness control model equation, thus minimizing the error. Thus, the initial settings for the sheet profile control can be precisely set. Moreover, the initial settings for controlling the sheet thickness can be precisely set.

The sheet thickness control model equation can be updated by using, for example, Equation (15):

$$h=S+P/M+P_B/M_B-\text{Oil}+C_w-C_T+GMC \quad (15)$$

where h is the sheet thickness, S is the rolling position, P is the rolling load, $P_B$ is bender load, M is a mill constant, $M_B$ is a bender mill constant, Oil is thickness of oil film, $C_w$ is the quantity of wear of the work roll, $C_T$ is thermal expansion of the work roll and GMC is a correction term.

When Equation (15) is used to update the model, all errors in M, $M_B$, $C_w$ and $C_7$ are corrected using the correction term GMC, and S and h are measured. As a result, Oil can be precisely predicted.

When the model is updated, using the roll profile meter enables the sum of $C_w$ and $C_T$ in Equation (15) to be measured. Therefore, the precision in updating the model can be further improved.

Figure 4:
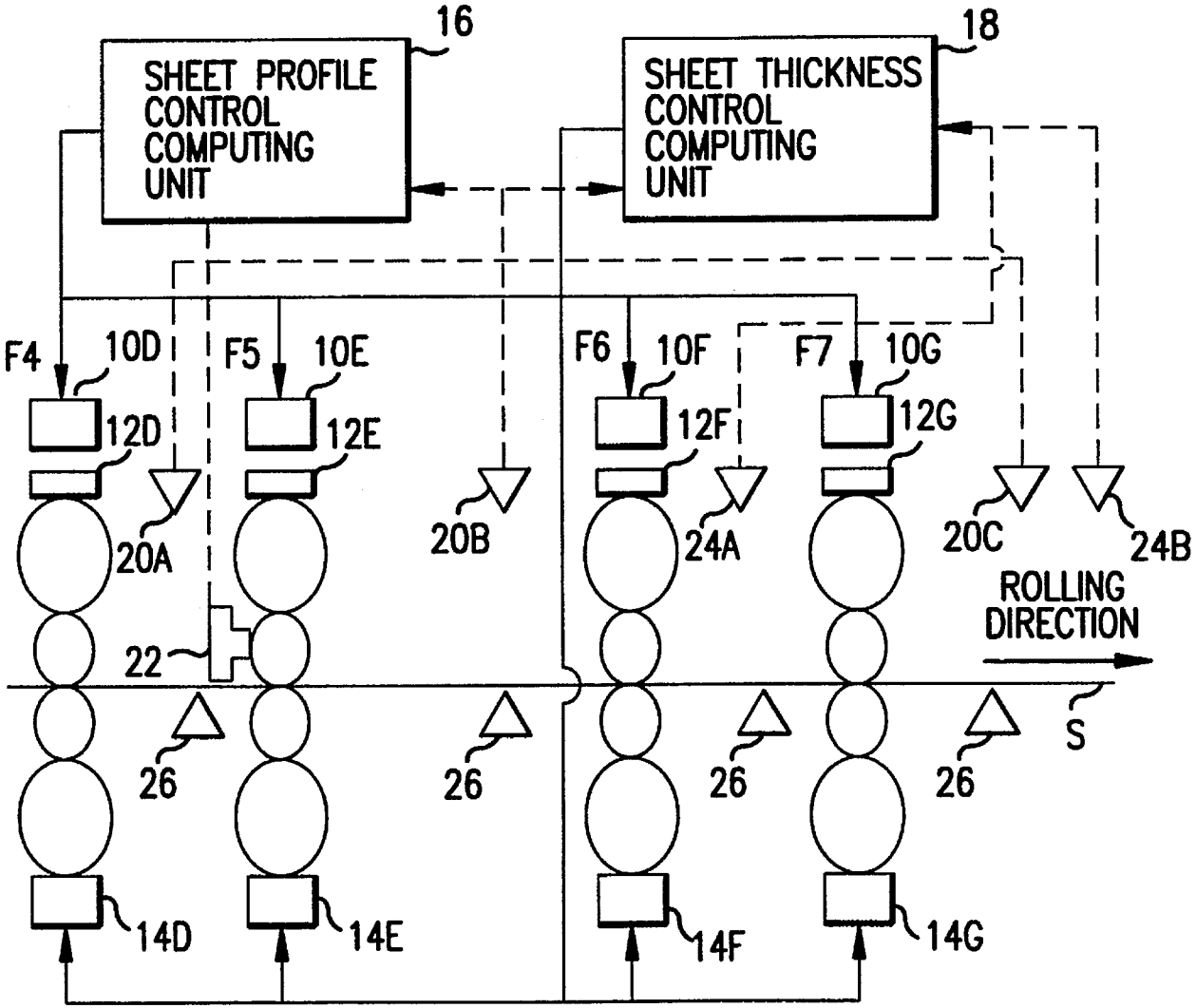
FIG. 4 is a schematic view which illustrates configuration of facilities in a hot strip finish rolling mill according to the present invention.

FIG. 4 shows a schematic view of a first preferred embodiment of a hot strip finish rolling mill adapted to the rolling control method of this invention. The finish rolling mill in this embodiment is a continuous rolling mill comprising seven stands, a first stand F1 to a seventh stand F7. FIG. 4 illustrates only the fourth stand F4 to the seventh stand F7. The stands F4–F7 of the rolling mill each has a load meter 12 and a sheet thickness control unit 14. The elements comprising the fourth to seventh stands, F4 to F7, are referred to using symbols D, E, F and G, respectively. Although they are not shown, the first to third stands, F1 to F3, have the same structure.

A sheet profile control computing unit 16 is connected to the sheet profile control devices 10D to 10G of the fourth to seventh stands F4 to F7. The computing unit 16 supplies control signals for controlling the sheet profile to the sheet profile control units 10D to 10G.

A sheet thickness control computing unit 18 is connected to the sheet thickness control units 14D to 14G. The computing unit 18 supplies control signals for controlling the sheet thickness to the sheet thickness control units 14D to 14G.

A first sheet profile meter 20A, a second sheet profile meter 20B and a third sheet profile meter 20C are disposed at corresponding positions, that is, in a fourth space between the fourth stand F4 and the fifth stand F5, a fifth space between the fifth stand F5 and the sixth stand F6 and at the outlet side of the seventh stand F7, respectively. Sheet profiles measured by the first to third profile meters 20A to 20C are supplied to the sheet profile control computing unit 16. A roll profile meter 22 is disposed at the work roll of the fifth stand F5. The roll profile measured by the roll profile meter 22 is similarly supplied to the sheet profile control computing unit 16.

A first sheet thickness meter 24A and a second sheet thickness meter 24B are disposed in a sixth space between the sixth stand F6 and the seventh stand F7 and at the outlet side of the seventh stand F7. The sheet thicknesses measured by the sheet thickness meters 24A and 24B are supplied to the sheet thickness control computing unit 18.

Further, one flatness meter 26 is disposed between each of the fourth stand F4 and the fifth stand F5, the fifth stand F5 and the sixth stand F6, the sixth stand F6 and the seventh stand F7, and at the outlet side of the seventh stand F7. The flatness meters 26 measure the flatness of a strip as it passes between the corresponding stands.

The operation of the embodiment shown in FIG. 4 will now be described while providing an example in which Equation (1) is employed as the sheet profile control equation. In this embodiment, the pass schedule is set so that the sheet thickness of the strip, as it passes between the fourth stand F4 and the fifth stand F5 (that is, the fourth between-space), is thicker than the percentage sheet crown critical sheet thickness. Specifically, the sheet thickness at the outlet side of the fourth stand F4 is 2 mm or more.

In this embodiment, when the leading portion or edge of the strip S to be rolled at stands F1 to F4, which are upstream from the fourth between-space containing the sheet profile meter 20A, has reached the sheet profile meter 20A, the sheet profile of the leading portion is measured.

After the sheet profile $Cr_4$ and the sheet thickness $h_4$ of the strip S at the outlet side of the fourth stand F4 have been measured by the first profile meter 20A, the measured values are supplied to the sheet profile control computing unit 16. In the sheet profile control computing unit 16, the measured values are converted into the percentage sheet crown $RC_4$. To make the percentage sheet crown $RC_4$ at the outlet side of the fourth stand F4 coincide with the desired percentage sheet crown $RC_4^{Des}$ the control change quantity is transmitted from the sheet profile control computing unit 16 to the sheet profile control unit 10D disposed in front of the fourth stand and the sheet profile control units 10A–10C for the first to third stands F1–F3, so that feedback control is performed.

After the sheet profile of the leading portion of the strip in the fourth between-space is updated by the feedback control, the percentage sheet crown of the sheet profile at the outlet side of the fourth stand F4 coincides with a desired percentage sheet crown $RC_4$ at the outlet side of the fourth stand F4. Therefore, rolling by the downstream stands F5 to F7 is performed under the constant percentage sheet crown condition. Accordingly, the sheet profile of product strip to be rolled by the seventh stand F7 will coincide with a desired sheet profile without disrupting the flatness of the sheet.

As described above, in this embodiment, the sheet profile meter 20A is disposed between the fourth stand F4 and the fifth stand F5 so that the sheet crown $Cr_4$ on the outlet side of the fourth stand F4 is obtained as an actual value in place of an assumed value, as in the conventional apparatus. As a result, the precision of controlling the sheet profile is significantly improved.

Since the sheet thickness of the strip, as it passes through the fourth between-space where the sheet profile meter 20A is disposed, is maintained between 4 mm or less and 2 mm or more, the crown can be freely changed without distorting the sheet shape at the upstream stands F1 to F4. Therefore, a similar method to the method using Equation (8) can be performed. This method comprises directly calculating the error $S_4$ at the fourth stand F4 to reduce the error $S_4$, and changing the crown control quantity to correct the deflection $Cmp_4$ of the roll occurring due to the rolling load, in order to make the percentage sheet crown $Rc_4$, measured at the fourth stand F4, coincide with the desired percentage sheet crown $Rc_4^{Des}$. As a result, feedback control exhibiting excellent response is obtained.

In addition to performing feedback control, feed-forward control is performed when an error has occurred at the fourth stand F4 between the percentage sheet crown obtained in accordance with the measurement and the desired percentage sheet crown. The feed-forward control method comprises transmitting, from the sheet profile control computing unit 16, the control change quantity to the stands F5–F7 downstream from the fourth stand F4. The control change quantity is the input to the load meters 12E, 12F and 12G disposed at the fifth stand F5, the sixth stand F6 and the seventh stand F7, respectively, in order to reduce the error between the sheet profile of the final product and the desired sheet profile at the outlet side of the seventh stand F7.

That is, based on the error between the percentage sheet crown obtained from the measurement of the leading portion of the strip and the desired percentage sheet crown, the sheet profile of the leading portion of the strip is modified by transmitting a required quantity of control, calculated by the sheet profile control computing unit 16, to the sheet profile control units 10E to 10G disposed downstream from the first sheet profile meter 20A. Since the quantity of the sheet profile that can be controlled is small at the downstream rolling stands 10E to 10G, the outputs to be supplied to the sheet profile control units 10E to 10G must be limited by means of calculations performed in the control computing unit 16 to cause the outputs to be maintained in an allowable range of the flatness.

However, the rolling mill of this embodiment ensures that the strip has a thickness of 2 mm or thicker when altering the percentage sheet crown, which enables the allowable range of flatness to be relatively wider than the percentage sheet crown change limit shown in, for example, FIG. 1. Therefore, the sheet profile can be controlled without causing defects to form in the sheet shape (i.e., the flatness).

Methods for controlling the final percentage sheet crown to drive it to the desired percentage sheet crown, by controlling the downstream stands F5 to F7 based on the measured percentage sheet crown $Rc_4$ on the outlet side of the fourth stand F4, are categorized into the following two methods. The first method compensates for the crown error occurring at the downstream stands F5 to F7 due to the error between the measured percentage sheet crown $Rc_4$ from the measured sheet profile $Cr_4$ at the outlet side of the fourth stand F4 and the desired percentage sheet crown $Rc_4^{Des}$ at the outlet side of the fourth stand F4. The quantity of the change in the percentage sheet crown for each of the downstream stands F5 to F7 in this case is obtained based on Equation (9).

The second method comprises predicting the sheet profile at the outlet side of the final stand when rolling has been allowed to proceed to the final stand, based on the previously set pass schedule from the percentage sheet crown $Rc_4$ from the measured sheet profile, and controlling the downstream stands F5 to F7 to make the predicted profile at the outlet side to approach the desired value. The predicted sheet profile at the outlet side of the final stand is obtained based on Equations (1) to (7). Further, the quantity of the change in the percentage sheet crown for each of the stands F5 to F7 is obtained based on Equation (10).

Since the shape is distorted, as described above, at the rear stands when the sheet thickness of the strip is reduced, the quantity of the percentage sheet crown $Rc_i$ that can be changed at the $i^{th}$ stand in the rear portion is limited. Therefore, it is important to approach the desired value within the limit determined by the changeable quantity $\Delta Rc_i$ of the percentage sheet crown determined from Equation (11), in order to maintain the strip passing characteristics.

$$\Delta Rc_i = f_6(h, b, D) \tag{11}$$

Although the changeable quantity of the percentage sheet crown at the downstream stands cannot be considered with the first method, the second method is able to include these factors. Thus, the second method is superior to the first method.

In this embodiment, the measurement with the sheet profile meter 20A is continued after the leading portion of the strip has passed through the fourth between-space. Therefore, even if an error occurs between the measured sheet profile and the desired value due to the change of the sheet profile of the strip, which has passed through the upstream stands, caused from thermal expansion or the progress of wear, the error can be corrected. As a result, the sheet profile of the product coincides with the desired sheet profile.

Results of actual control of the sheet profile will now be described in order to clarify the effect on the control method using the sheet profile measured by the first sheet profile meter 20A. A sheet bar having a thickness of 30 mm was rolled based on a pass schedule shown in Tables 1 and 2. The sheet bar was subjected to sheet profile control arranged so that the distances between stands at which the sheet profile meters were disposed was varied to measure the sheet profile at the positions at which the sheet thickness varied. In accordance with the measured sheet profile, stands upstream from the position of the sheet profile meter were feedback-controlled. The stands downstream from the position at which the sheet profile meter was disposed were feed-forward-controlled under a constant percentage sheet crown condition.

TABLE 1

| | sheet bar | F1 | F2 | F3 | F4 | F5 | F6 | F7 |
|---|---|---|---|---|---|---|---|---|
| Sheet thickness (mm) | 30 | 15.0 | 8.4 | 4.9 | 3.1 | 2.0 | 1.45 | 1.20 |

TABLE 2

| | sheet bar | F1 | F2 | F3 | F4 | F5 | F6 | F7 |
|---|---|---|---|---|---|---|---|---|
| Sheet thickness (mm) | 30 | 16.5 | 10.0 | 6.4 | 4.3 | 3.2 | 2.4 | 2.0 |

Figure 5:
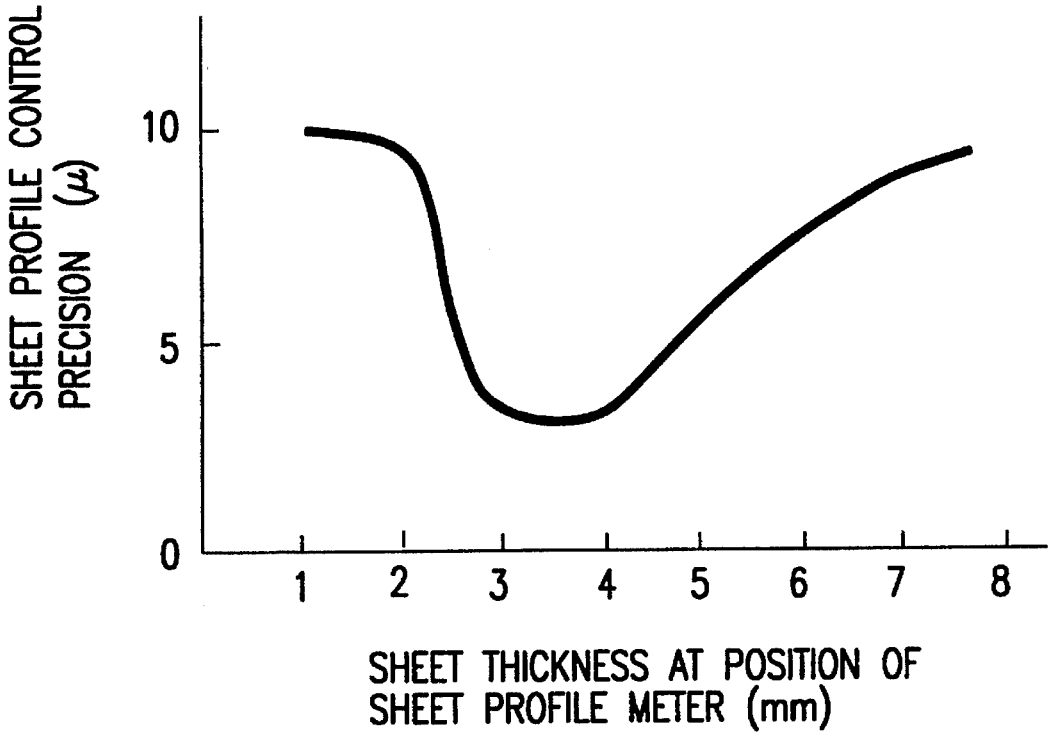
FIG. 5 is a graph which illustrates the relation between positions of a sheet profile meter between stands and control precision.

FIG. 5 is a graph which illustrates the correlation between the sheet profile control precision, measured in micrometers (μm), and the passage sheet thickness, measured in millimeters (mm), at the sheet profile meter. The sheet profile control precision (μm) is defined as the error between a measured sheet profile at the outlet side of the final stand obtained from the sheet profile control and a desired sheet profile.

As shown in FIG. 5, the control precision is improved if the passage thickness is thicker than 2 mm, and is minimized when the passage thickness is 3.5 mm. If the passage thickness becomes thicker than 4 mm, the control precision deteriorates gradually, and accordingly, the effect of the control is at last lost.

The improvement in the control precision realized when the sheet thickness was thicker than 2 mm is due to the rapid rise in the percentage sheet crown change limit determined due to the shape limit shown in FIG. 1. The deterioration of the control precision occurring when the sheet thickness exceeds 4 mm is due to the reduction in the crown heredity coefficient $\beta_i$ as shown in FIG. 2, and the increase in the number of rolling operations until the strip is formed into the final product.

Thus, the preferred position for the sheet profile meter is a position between those stands in which the sheet thickness of the strip is 4 mm or thinner and 2 mm or thicker. The first sheet profile meter 20A is disposed in the fourth space between the stands and the second sheet profile meter 20B is disposed in the fifth space. The fifth stand F5 can thus be controlled using the measured sheet crown $Cr_5$ at the outlet side of the fifth stand F5 obtainable at the second sheet profile meter 20B, when the sheet profile control is performed based on with the measured sheet profile obtained from the first sheet profile meter 20A. Therefore, the sheet profile control can be performed at the fifth stand F5 based on a measured value in place of an estimated value. As a result, the control precision is further improved.

In this embodiment, the sheet crown $Cr_4$ at the outlet side of the fourth stand F4 is measured by the first sheet profile meter 20A, the sheet crown $Cr_5$ at the outlet side of the fifth stand F5 is measured by the second sheet profile meter 20B, the roll profile $Cmr_5$ of the work roll at the fifth stand F5 is measured by the roll profile meter 22, and the rolling load P5 at the fifth stand F5 is measured by the load meter 12E. The measured values are supplied to the sheet profile control computing unit 16.

The sheet profile control computing unit 16 calculates the crown $Cmp_5$ occurring due to the error of the roll at the fifth stand F5 based on the rolling load P5, using Equation (6). Then, the crown $Cmp_5$ and the measured values are applied to Equation (1), which is the model equation. As a result, the mechanical crown imprinting ratio $\alpha_i$ in Equation (5) and the crown heredity coefficient $\beta_i$ in Equation (7) are obtained. By changing the update correction factors (regression factor $K_{ch}$ and shape factor $\xi$) in the calculation model equation, the precision when initially setting the condition for the next material to be rolled is improved.

More specifically, when the sheet profile meters 20A and 20B are disposed around the fourth rolling stand having the roll profile meter, all of the factors required to calculate the crown from Equation (1) are measurable. These factors include the sheet crown $Cr_i$ at the outlet side of the stand $F_i$ (here, i=4), the sheet crown $Cr_{i-1}$ at the outlet side of the stand disposed upstream of the stand $F_i$, and the sum ($CmRh_i$+$CmRw_i$) of the crown from the thermal expansion of the roll of the stand $F_i$ and the crown realized due to the wear of the roll of the stand $F_i$. As a result, the residual error factors are only the imprinting ratio $\alpha_i$ and the crown heredity coefficient $\beta_i$. Therefore, the imprinting ratio $\alpha_i$ and the crown heredity coefficient $\beta_i$ can easily be optimized using a regression method. Since the imprinting ratio $\alpha_i$ and the crown heredity coefficient $\beta_i$ are varied due to the widthwise temperature distribution in the material, and the characteristics of the material, and the degree of the change occurring due to a particular stand is limited, no critical problem rises if the factors obtained at a specific stand are applied to the other stands.

In this embodiment, the first sheet profile meter 20A and the second sheet profile meter 20B are able to measure the sheet thickness $h_4$ at the central portion of the strip at the outlet side of the fourth stand F4 and the sheet thickness $h_5$ at the central portion of the strip at the outlet side of the fifth stand F5. Further, the sheet thickness meter 24A is able to measure the sheet thickness $h_6$ at the central portion of the strip. The measured sheet thicknesses are supplied to the sheet thickness control computing unit 18 so that the measured values and the predetermined desired sheet thickness are subjected to a comparison in the sheet thickness control computing unit 18. By changing the control quantity to be set to the sheet thickness control unit 14 to reduce the error, the sheet thickness can also be precisely determined.

By disposing the first profile meter 20A at the fourth between-space (the third position counted from the downstream position), the difference in the sheet thickness in the widthwise direction of the strip can also be detected. Since the fourth between-space is the position at which the sheet profile can be corrected, feed-forward control is performed if the sheet thickness varies in the widthwise direction, the feed-forward control being arranged so that the fifth stand F5, the sixth stand F6 and the seventh stand F7 are feed-forward controlled to eliminate the error in the sheet thickness occurring in the widthwise direction. Thus, zigzag passing of the final product of the strip S is prevented. By preventing zigzag passing of the strip S, problems, such as reduction, which can occur when the leading portion and the trailing edge are allowed to pass, can be satisfactorily prevented.

The flatness meters 26 are disposed at each space between the stands in this embodiment to measure the sheet shape of the strip S. Thus, the flatness meters 26, by supplying the measured sheet shape to the sheet profile control computing unit 16, allow the model to be updated based on the detected flatness, which adequately prevents distortion of the sheet shape which occurs when excessively controlling the sheet profile.

As described above, according to this embodiment, the sheet profile meter 20A is disposed in the space between the stands in which the sheet thickness of the strip is 4 mm or less. Therefore, the feedback control of the rolling stands disposed upstream from the position of the sheet profile meter 20A is performed based on the measurement from the sheet profile meter 20A so that the strip profile coincides with the desired sheet profile. By feed-forward-controlling the downstream stands, the sheet profile of the product at the outlet side of the final stand coincides with the desired sheet profile even if a further error occurs between the results of the measurement performed by the sheet profile meter 20A and the desired value. In actual practice, an error of 30 μm involved in the sheet profile control accuracy realized by the conventional method was reduced to 10 μm or less using the method of this invention.

In contrast with the conventional method, in which the sheet profile meter is disposed in the vicinity of the outlet side of the tandem rolling mill, the feedback control of this invention enables the length of the material required to perform the feedback control to be significantly shortened. That is, the length of the sheet output between detecting the error and fully correcting the error is reduced. Thus, the amount of wasted material is reduced. It should be noted that the distance from the outlet side of the fourth stand F4 to the outlet side of the seventh stand F7 is about 20 m if conversion into the length of the strip is made.

The foregoing feed-forward control enables the sheet profile control to be performed based on the measured value obtained by the sheet profile meter 20A. Therefore, the control precision can be significantly improved compared with the conventional prediction control method.

According to this embodiment, the sheet profile between the stands, which cannot be detected with the conventional technology, can be detected. Furthermore, the roll profile of the two contiguous stands, between which the sheet profile meter is disposed, can be measured by the roll profile meter. Therefore, the state of the sheet profile on each of the inlet side and the outlet side of that rolling stand and that of the roll profile can directly be measured.

Therefore, the dissociation of the imprinting ratio $\alpha_i$ and the crown heredity coefficient $\beta_i$ of the mechanical crown from the model equation can be quantitatively and directly grasped. As a result, the precision of the control model equation can be significantly improved. Accordingly, the precision in initially setting each control unit when rolling the next sheet material can be significantly improved.

As many apparently widely different embodiments of this invention may be made without departing from the spirit and scope thereof, it is to be understood that the invention is not limited to the specific embodiments thereof.

For example, the present invention is not limited to the finish rolling mill comprising the seven stands employed in the foregoing embodiment. Although the finish rolling mill comprising seven stands has the first sheet profile meter 20A disposed in the fourth space between the stands, where the sheet thickness of the strip is 4 mm or thinner and 2 mm or thicker, the present invention is not limited to this embodiment.

Although this embodiment has the thickness meter disposed in the sixth space in front of the seventh stand F7, a sheet profile meter may be disposed in place of the sheet thickness meter. However, since the sheet thickness is too thin in this space between the stands, the freedom in controlling the sheet profile is unsatisfactorily excessive. Therefore, it is advantageous to dispose the sheet thickness meter in the final space between the stands, as in the first embodiment, to obtain the economic advantage.

Figure 6:
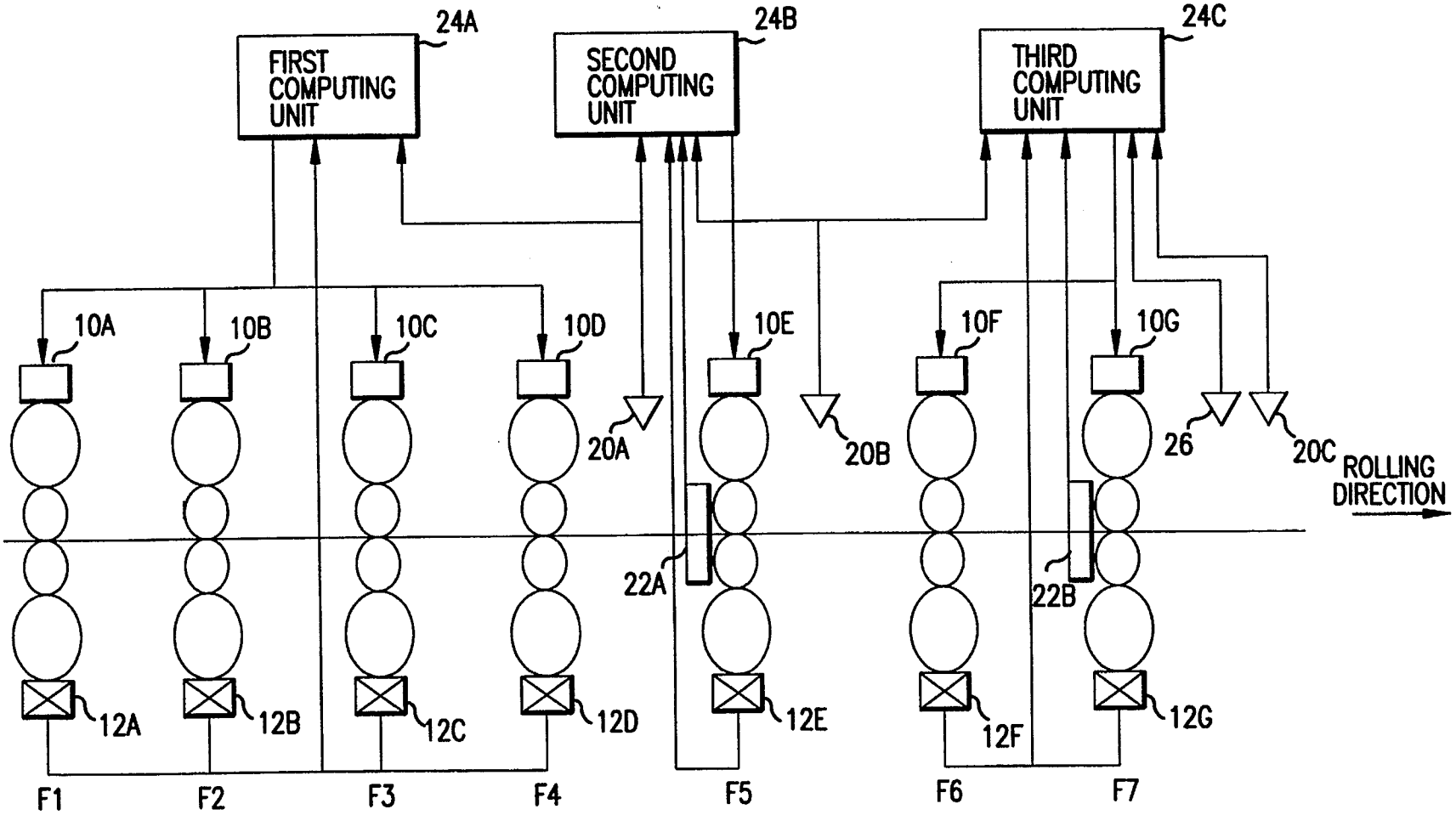
FIG. 6 is a schematic view which illustrates another configuration of facilities in the hot strip finish rolling mill according to the present invention.

FIG. 6 is a schematic view of a second embodiment of the hot strip finish rolling mill adapted to the rolling control method according to this invention. The finish rolling mill used in this embodiment is a continuous rolling mill comprising seven stands, the first to seventh stands F1 to F7. Each stand has a sheet profile control unit 10 and a load meter 12. In the fourth space between the fourth stand F4 and the fifth stand F5, the fifth space between the fifth stand F5 and the sixth stand F6, and at the outlet side of the seventh stand F7, a first sheet profile meter 20A, a second sheet profile meter 20B and a third sheet profile meter 20C are respectively disposed. A flatness meter 26 is disposed at the outlet side of the seventh stand F7. Finally, first and second roll profile meters 22A and 22B are disposed at the position of the work roll of the fifth and seventh stands F5 and F7, respectively.

The finish rolling mill has first to third control computing units 24A to 24C for performing calculations to control the sheet profile and to update the control model equation. The first control computing unit 24A is supplied with detection signals from the load meters 12A to 12D of the first to fourth stands F1 to F4 and the first sheet profile meter 20A. The control computing unit 24A transmits control signals to the sheet profile control units 10A to 10D of the stands F1 to F4.

The second control computing unit 24B is supplied with detection signals from the load meter 12E of the fifth stand F5, the first and second sheet profile meter 20A and 20B and the first roll profile meter 22A. The second control computing unit 24B transmits a control signal to the sheet profile control unit 10E of the stand F5.

The third control computing unit 24C is supplied with detection signals from the load meters 12F and 12G of the sixth and seventh stands F6 and F7, the second and third profile meters 20B and 20C, the flatness meter 26 and the second roll profile meter 22B. The third control computing unit 24C transmits control signals to the sheet profile control units 10F and 10G of the stands F6 and F7.

The operation of this embodiment will now be described while providing an example in which foregoing Equations (1) and (2) are used as the control model equations for the sheet profile. The pass schedule is set so that the sheet thickness of the strip to be rolled by the fourth stand F4 is 4 mm or thinner and 2 mm or thicker. The sheet profile of the strip S rolled by the first to fourth stands F1 to F4, upstream from the fourth space in which the first sheet profile meter 20A is disposed, is measured when it reaches the first sheet profile meter 20A. The sheet profile of the strip S is measured by the first sheet profile meter 20A at the outlet side of the fourth stand F4. The measured sheet profile $Cr_4$ and measured rolling loads $P_1$ to $P_4$ at the first to fourth stands F1 to F4 at the rolling process are, from the load meters 12A to 12D, supplied to the first control computing unit 24A.

The first control computing unit 24A calculates an error, $S_4$, obtainable from Equation (8), between the measured sheet profile $Cr_4$ and a predicted sheet profile on the outlet side of the fourth stand F4. The predicted sheet profile obtained by applying the rolling conditions, such as the measured rolling load $P_4$, to the Equations (1) and (2). In order to reduce the error $S_4$, the correction terms are updated.

The sheet profiles $Cr_1$ to $Cr_4$ at the corresponding outlet sides of the first to fourth stands F1 to F4 are formulated in Equations (16)–(19), and correction terms included in the corresponding equations are obtained.

$$Cr_1=\alpha_1(Crm_1+C_1)+\beta_1\cdot Cr_0 \tag{16}$$

$$Cr_2=\alpha_2(Crm_2+C_2)+\beta_2\cdot Cr_1 \tag{17}$$

$$Cr_3=\alpha_3(Crm_3+C_3)+\beta_3\cdot Cr_2 \tag{18}$$

$$Cr_4=\alpha_4(Crm_4+C_4)+\beta_4\cdot Cr_3 \tag{19}$$

Assuming that $C_1=C_2=C_3=C_4=C$, Equation (19) is transformed into Equation (20):

$$Cr_4=\alpha_4\cdot Crm_4+\beta_4\cdot\alpha_3\cdot Crm_3+\beta_4\cdot\beta_3\cdot\alpha_2\cdot Crm_2+\beta_4\cdot\beta_3\cdot\beta_2\cdot\alpha_1\cdot Crm_1+\beta_4\cdot\beta_3\cdot\beta_2\cdot\beta_1\cdot Cr_0+C(\alpha_4+\beta_4\cdot\alpha_3+\beta_4\cdot\beta_3\cdot\alpha_2+\beta_4\cdot\beta_3\cdot\beta_2\cdot\alpha_1) \tag{20}$$

In accordance with Equation (20), the correction term C is corrected in order to make the sheet profile $Cr_4$ of the fourth stand F4 coincide with the measured sheet profile.

When the calculation of Equation (1) is performed, an estimated value may be employed as the sheet profile $Cr_3$ on the inlet side of the fourth stand F4.

In the case where $Cr_3$ is estimated when updating the model, the flatness meter is disposed on the outlet side of the fourth stand F4. The flatness meter is then used to measure the steepness $\lambda_4$, which is then used to estimate $Cr_3$ from the relationship expressed in Equation (21):

$$\lambda_4=(2/\pi)\cdot\{\xi_4(Cr_4/h_4-Cr_3/h_3)\}^{0.5} \tag{21}$$

If the sheet profile $Cr_3$ at the outlet side of the third stand F3 can be estimated as described above, the sheet profile $Cr_4$ can be updated using Equation (22) to make the sheet profile $Cr_4$ at the outlet side of the fourth stand F4 coincide with the measured value.

$$Cr_4=\alpha_4(Crm_4+C_4)+\beta_4\cdot Cr_3 \tag{22}$$

If the sheet profile $Cr_3$ can be estimated as described above, updating the model based on the first to third stands F1 to F3 can be performed similarly to the case where Equation (20) is used. By updating the correction term as described above, the precision of the sheet profile prediction of the strip to be rolled next can be improved. Therefore, the precision in setting the initial conditions for the sheet profile control unit 10 can be improved.

Although this method is arranged such that the model is updated assuming that the error occurs due to the predicted error in the roll profile, the model may be updated by dividing the error into the roll profile prediction error and an error from the specification of the material to be rolled. This updating method can then be based on Equation (12).

In this embodiment, the first sheet profile meter 20A measures the sheet profile $Cr_4$ on the outlet side of the fourth stand F4, the second sheet profile meter 20B measures the sheet profile $Cr_5$ on the outlet side of the fifth stand F5, the first roll profile meter 22A measures the roll profile $Cmr_5$ of the work roll of the stand F5 and the load meter 12E measures the rolling load $P_5$ of the stand F5. The measured values are supplied to the second control computing unit 24B.

The second control computing unit 24B, from the rolling load $P_5$ at the fifth stand F5, calculates crown $Cmp_5$ formed due to the error in the roll at the stand F5 from Equation (3). The crown $Cmp_5$, together with the measured value, is applied to Equations (1) and (2) which are model equations. As a result, the imprinting ratio $\alpha_i$ of the mechanical crown and the crown heredity coefficient $\beta_i$ of the profile on the inlet side are obtained by a regression method. Thus, the update coefficients (the regression factor $K_{ch}$ and the shape factor $\xi$) in Equations (5) and (7), which are calculation models, are determined so that the precision in setting the initial conditions for the next sheet material to be rolled is improved.

More specifically, the sheet profile meters 20A and 20B bracket the rolling stand having the roll profile meter. This enables the sheet crown $Cr_5$ at the outlet side of the fifth stand F5 and the sheet crown $Cr_4$ at the outlet side of the previous stand to be measured. These factors are required to calculate the sheet profile from Equations (1) and (2) and to calculate the sum ($CmRh_5$+$CmRw_5$) of the crown occurring due to thermal expansion of the roll of the stand F5 and the crown occurring due to the wear of the roll. Therefore, the residual error factors are only the imprinting ratio $\alpha_i$ and the crown heredity coefficient $\beta_i$. Therefore, the imprinting ratio $\alpha_i$ and the crown heredity coefficient $\beta_i$ can easily be optimized by a regression method.

According to this embodiment, the sheet profile between the stands, which cannot be detected in the conventional structure, can now be detected. Furthermore, the roll profile meter, disposed at a rolling stand disposed between the two contiguous stands, is able to measure the roll profile at the rolling stand. As a result, the sheet profile on the inlet and outlet sides of the rolling stand and the state of the roll profile can be directly measured.

Therefore, the disassociation between the imprinting ratio $\alpha_i$ of the mechanical crown and the crown heredity coefficient $\beta_i$ from the model equation can be quantitatively and directly recognized. Therefore, the precision of the control model equation is significantly improved.

In this embodiment, the imprinting ratio $\alpha_i$ and the crown heredity coefficient $\beta_i$ from Equations (1) and (2) are estimated and updated to improve the precision of $\alpha_i$ and $\beta_i$ at the next rolling operation. This method is able to update the control model so that the error occurring due to the error in predicting the roll profile and the error occurring due to the specifications of the material to be rolled can be separated.

In this embodiment, the third control computing unit 24C is supplied with rolling loads $P_6$ and $P_7$ of the sixth and seventh stands F6 and F7, measured by the load meters 12F and 12G, the sheet profiles $Cr_5$ and $Cr_7$, measured by the second profile meter 20B and the third profile meter 20C, the flatness measured by the flatness meters 26 and the roll profile ($CmRh_i$+$CmRw_i$) of the seventh stand F7 measured by the second roll profile meter 22B.

The third control computing unit 24C uses the flatness measured by the flatness meters 26 to enable the sheet profile $Cr_6$ at the inlet side of the seventh stand F7 (or at the outlet side of the sixth stand F6) to be easily estimated. As a result, updating the control model from the seventh stand F7 can be performed by using the estimated sheet profile similarly to the case of the fifth stand F5.

That is, if the flatness (the steepness) $\lambda_7$ can be measured by the flatness meter 26 disposed at the outlet side of the seventh stand F7, then the sheet profile $Cr_5$ at the inlet side of the seventh stand F7 can be estimated in accordance with the relation expressed by Equation (23):

$$\lambda_7=(2/\pi)\cdot(\xi_7(Cr_7/h_7-Cr_6/h_8)\}^{0.5} \tag{23}$$

In updating the control model, the third control computing unit 24C may use the roll profile of the sixth stand F6 measured by the roll profile meter disposed at the sixth stand F6. In this case, the thermal expansion and the wear of the roll can be measured by the roll profile meter disposed at the sixth stand F6. Therefore, the mechanical crown $Crm_6$ can precisely be predicted, such that the imprinting ratio $\alpha_i$ and crown heredity coefficient $\beta_i$ can be precisely estimated. Therefore, updating the model can be improved. As a result, application of the sheet profile $Cr_5$ measured at the outlet side of the fifth stand F5 from Equation (24) enables the sheet profile $Cr_6$ at the outlet side of the sixth stand F6 to be estimated precisely. Equation (24) states:

$$Cr_6=\alpha_6\cdot Crm_6+\beta_6\cdot Cr_5 \tag{24}$$

The measured roll profiles of both of the sixth stand F6 and the seventh stand F7 may be employed. In this case, the model is updated similarly to a case where the roll profile meter is disposed at the sixth stand F6. Thus, use of both roll profiles enables updating the model to be further improved.

As many apparently widely different embodiments of this invention may be made without departing from the spirit and scope thereof, it is to be understood that the invention is not limited to the specific embodiments thereof.

Although the foregoing embodiment has been described about the case where the finish rolling mill comprises seven stands, the present invention is not limited to this. Although the finish rolling mill comprising the seven stands has the first sheet profile meter 20A which is disposed in the fourth space in which the thickness of the strip is 4 mm or thinner and 2 mm or thicker, the present invention is not limited to this. The positions and the number of the sheet profile meters, the roll profile meters and the flatness meters are not limited to the descriptions about the foregoing embodiments. They may be arbitrarily varied.

Although omitted from the descriptions of the preferred embodiments, the measured roll profile may be omitted when the measured sheet profile is used between every two contiguous stands. Further, updating the sheet thickness control model equation may be simultaneously performed.

Although the invention has been described in its preferred embodiments with a certain degree of particularly, it is understood that the present disclosure of the preferred form can be changed in the details of construction and the combination and arrangement of parts may be resorted to without departing from the spirit and the scope of the invention as hereinafter claimed.

What is claimed is:

1. A method for controlling a hot strip finish rolling mill having a plurality of sequentially disposed rolling stands, comprising the steps of:

measuring a sheet profile of a sheet at an outlet side of a selected intermediate stand, wherein a sheet thickness of the sheet at the outlet side of the selected intermediate stand is a percentage sheet crown critical sheet thickness;

obtaining an error measurement between the measured sheet profile and a desired sheet profile at the outlet side of the selected intermediate stand; and controlling the rolling stands positioned upstream from the selected intermediate stand based on the error measurement to achieve the desired sheet profile at the outlet side of the selected intermediate stand and to alter the profile of the sheet at each upstream stand within a first percentage sheet crown change limit.

2. The method for controlling the hot strip finish rolling mill of claim 1, further comprising the step of:

feed-forward controlling the rolling stands positioned downstream from the selected intermediate stand based on the error measurement;

wherein the downstream rolling stands are controlled to alter the profile of the sheet within a second percentage sheet crown change limit.

3. The method for controlling the hot strip finish rolling mill of claim 1, wherein control of rolling stands positioned downstream from the selected intermediate stand is performed such that a percentage sheet crown of the sheet is held constant.

4. The method for controlling the hot strip finish rolling mill of claim 1, wherein the sheet profile is measured at the outlet side of the rolling stands upstream from the selected stand; and control of the rolling stands downstream from the selected stand is performed such that a percentage sheet crown of the sheet is held constant.

5. The method for controlling the hot strip finish rolling mill of claim 1, wherein an error value is determined between the sheet profile measured at the outlet side of the selected stand and a predicted sheet profile obtained based on a sheet profile control model equation; and the sheet profile control model is updated based on the measured sheet profile to modify at least one correction term of the sheet profile control model to reduce subsequently determined error values.

6. The method of claim 5, wherein sheet profiles are measured after each of the plurality of rolling stands and at least one correction term of the sheet profile control model is updated based on the measured sheet profiles.

7. A method for controlling a hot strip finish rolling mill comprising the steps of:

continuously measuring sheet profiles at an inlet side and an outlet side of a selected rolling stand;

determining a mechanical crown of the selected rolling stand based on a measured rolling load detected when rolling a sheet with the selected rolling stand of the hot strip finish rolling mill; and updating, based on the measured sheet profiles and the determined mechanical crown, an imprinting ratio of said mechanical crown of a sheet profile control model and a crown heredity coefficient of a sheet profile on the inlet side of the selected rolling stand.

8. A hot strip finish rolling mill comprising:

a plurality of sequentially disposed rolling stands;

a sheet profile meter positioned downstream of a selected one of the plurality of rolling stands, a sheet thickness of a rolled sheet at an outlet side of the selected rolling stand being at a percentage sheet crown critical sheet thickness; and a control system determining an error measure between a desired sheet profile and an actual sheet profile measured by the sheet profile meter, the control system operating at least one of a downstream set of rolling stands using feed-forward control and an upstream set of rolling stands using feedback control based on the error measure.

9. The hot strip finish rolling mill of claim 8, wherein additional sheet profile meters are positioned between ones of the plurality of rolling stands positioned upstream of the selected rolling stand.

10. The hot strip rolling mill of claim 8, wherein the selected rolling stand is positioned upstream from a downstream-most one of the plurality of rolling stands.

11. The hot strip rolling mill of claim 10, wherein the selected rolling stand is positioned upstream at least two rolling stands from the downstream-most rolling stand.

* * * * *